US011332216B1

(12) United States Patent
Plante et al.

(10) Patent No.: US 11,332,216 B1
(45) Date of Patent: May 17, 2022

(54) INFLATABLE SHUTTLE BOAT

(71) Applicant: Indian Industries, Inc., Evansville, IN (US)

(72) Inventors: Thomas M. Plante, Woodbury, MN (US); Michael Christopher Shine, St. Paul, MN (US)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 16/949,600

(22) Filed: Nov. 5, 2020

Related U.S. Application Data

(60) Provisional application No. 62/930,912, filed on Nov. 5, 2019.

(51) Int. Cl.

| | |
|---|---|
| ***B63B 7/08*** | (2020.01) |
| ***B63B 5/24*** | (2006.01) |
| *B63B 34/54* | (2020.01) |
| *B63B 34/60* | (2020.01) |

(52) U.S. Cl.
CPC ..... *B63B 7/087* (2013.01); *B63B 5/24* (2013.01); *B63B 34/54* (2020.02); *B63B 34/60* (2020.02)

(58) Field of Classification Search
CPC ..... B63B 7/087; B63B 5/24; B63B 34/54; B63B 34/60
See application file for complete search history.

(56) References Cited

U.S. PATENT DOCUMENTS 6,386,932 B1 * 5/2002 Murphy ..... B63B 43/12 114/274
7,261,607 B1 * 8/2007 Klimenko ..... B60V 1/08 441/65
8,696,396 B1 * 4/2014 Churchill ..... B63B 34/54 441/132
9,126,655 B2 * 9/2015 Swan ..... B63H 16/06
RE47,021 E * 9/2018 Churchill ..... A63B 69/187
2005/0022715 A1 * 2/2005 Dunn ..... B63B 34/22 114/345

(Continued)

OTHER PUBLICATIONS

Inflatable Flying Fish Tube Banana Boat—Inflatable Flying Towable [online], [retrieved on May 25, 2021], Retrieved from <https://www.inflatable-zone.com/products/free-shipping-inflatable-flying-fish-tube-banana-boat-inflatable-flying-towable-inflatable-zone-tm>.

(Continued)

*Primary Examiner* — S. Joseph Morano
*Assistant Examiner* — Jovon E Hayes
(74) *Attorney, Agent, or Firm* — Woodard, Emhardt, Henry, Reeves & Wagner, LLP

(57) ABSTRACT

An inflatable shuttle boat including a seat tube, a pair of exterior buoyancy tubes, and a pair of foot support tubes. The seat tube has an elongate, cylindrical outer surface that is centrally located and extends from a front end to an aft end, the seat tube sized for single-file, straddled seating of a plurality of riders on top of the cylindrical outer surface. The pair of exterior buoyancy tubes have an elongate shape providing exterior sides of the inflatable shuttle boat, each of the pair of exterior buoyancy tubes having a larger diameter and height than the seat tube and extend in a parallel disposition to the seat tube at right and left sides. The pair of foot support tubes have elongate shapes extending adjacent and parallel to the seat tube in coupled engagement between the pair of exterior buoyancy tubes and the seat tube.

20 Claims, 8 Drawing Sheets

(56) References Cited

U.S. PATENT DOCUMENTS

| | | | | |
|---|---|---|---|---|
| 2006/0144313 | A1* | 7/2006 | Toussi | B63B 34/22 114/345 |
| 2014/0150705 | A1* | 6/2014 | Wundt | B63B 1/06 114/345 |
| 2019/0080655 | A1* | 3/2019 | Mueller-Diveky | B60N 2/02 |

OTHER PUBLICATIONS

High Quality Inflatable Fly Fish Boat—Inflatable Towable Fly Boat Inflatable Zone [online], [retrieved on May 25, 2021], Retrieved from <https://www.inflatable-zone.com/products/high-quality-inflatable-fly-fish-boat-inflatable-towable-fly-boat-inflatable-zone-tm>.

Inflatable Flying Fish Boat Towables Toys for Water Tours, Inflatable Zone [online], [retrieved on May 25, 2021], Retrieved from <https://www.inflatable-zone.com/products/free-shipping-inflatable-flying-fish-boat-towables-toys-for-water-tours-inflatable-zone-tm?_pos=5&_sid=cbcfbc6a2&_ss=r>.

Island Hopper 12 Passenger Banana Taxi Elite Class Heavy Commercial Banana Boat [online], [retrieved on May 25, 2021], Retrieved from <https://www.amazon.com/Island-Hopper-Passenger-Banana-Commercial/dp/B005S4RR54#:~:text=The%20Island%20Hopper%20%22Elite%20Class,1100%20denier%2040%20oz%20PVC>.

Waterboggan [online], [retrieved on May 25, 2021], Retrieved from <https://www.ravesports.com/products/waterboggan?_pos=1&_sid=15b194660&_ss=r>.

Waterboggan Operator's Manual, published Mar. 2008.

* cited by examiner

INFLATABLE SHUTTLE BOAT

RELATED APPLICATION

The present application claims the benefit of U.S. Provisional Application No. 62/930,912 entitled "INFLATABLE SHUTTLE BOAT", filed Nov. 5, 2019, which is incorporated herein by reference in its entirety.

TECHNICAL FIELD

This disclosure relates generally to inflatable boats, and, more particularly, to inflatable shuttle boats.

BACKGROUND

Many people enjoy water sports, including being towed at high speeds while sitting in or on an inflatable raft or boat. These boats are designed in a variety of shapes and sizes, for different levels of intensity. Some are designed specifically for ease of flipping the passengers on board into the water, while others are designed to never flip and maximize safety for smaller kids. Other inflatable boats are used for transferring passengers from the shore to a moving motorized boat; for example to reach a moving motorized boat that is being used for parasailing or other pleasure riding.

The "banana boat" is another popular inflatable boat, and includes a long tube to straddle, usually with much smaller tubes on each side for foot placement and boat stability. The main tube is usually yellow and shaped like a banana, contributing to its name. Other versions of the banana boat include two connected "banana" tubes that are side-by-side, with three or four stabilizing tubes. Many operations use these or similar inflatable boats as shuttles from the shore to moving power boats that are used for parasailing or other pleasure riding, with riders hopping from the shuttle boat to the motorized boat while both are stationary or in motion.

While banana boats are common and quite popular, especially among tourists in destination locales, they can also be very dangerous when used as shuttles from shore to moving motorized boats. Many people have been injured or died after being thrown from a banana boat at 30 miles per hour, breaking bones, becoming unconscious and floating face down, or even getting trapped under the boat. During transfer to motorized boats, people often fall due to the bumpy riding as the shuttle and motorized boats are both in motion. Thus, there is a need for a safer and more stable inflatable shuttle boat that includes an inflated tube to be straddled, and that will facilitate safe transfer of riders during movement.

SUMMARY

Embodiments described or otherwise contemplated herein substantially provide a watersport user with a safe, stable, inflatable shuttle boat to be used for towing behind a motorized watercraft on the water and to be used for safe transfer of riders to moving motorized boats used for parasailing and the like. While certain embodiments may be compared to a banana boat to illustrate the method of use of the boat, disclosed embodiments are plainly distinguishable and should not be considered banana boats. Rather, they are novel, inflatable, and towable shuttle boats.

In various embodiments, the boat includes an interior "seat" tube, foot support tubes on each side, and additional larger diameter exterior buoyancy tubes on the outer sides of the foot support tubes. Additionally, the seat tube and larger diameter exterior buoyancy tubes connect at the prow of the boat and lift upwards away from the water, to facilitate with fluid dynamics during towing, and increase safety during rough water. In other embodiments, the number of seat tubes, foot support tubes, and external tubes may be greater or less than in the preferred embodiment, and the prow may be designed at various heights and angles.

The larger diameter exterior buoyancy tubes are designed to fit tightly against any motorized boat hull, to facilitate safe transfer of riders from the shuttle to the motorized boat while both are in motion. This lessens the chance of falling overboard, and increases stability during motion.

In an embodiment, the seat tube may extend farther forward toward the prow end than the larger diameter exterior buoyancy tubes so as to act as a keel. The seat tube may also extend farther aft then the larger diameter exterior buoyancy tubes. The aft end of the seat tube may have a variety of shapes including a shape to match the larger diameter exterior buoyancy tubes.

In an embodiment, the center seat tube has a forward flared end to mate with the prow tube. Additionally, the foot support tubes disposed between the center seat tube and the larger diameter exterior buoyancy tubes are angled at the aft end to mate with the center tube.

In an embodiment, the larger diameter exterior buoyancy tubes are connected at the prow to form a "U" shape. In another embodiment, a prow tube may connect the larger diameter exterior buoyancy tubes. PVC panels may extend from the larger diameter exterior buoyancy tubes to the seat tube approximate the prow to cover any exposed openings between the tubes. Additional PVC panels may extend on the underside of the boat and across the prow, to act as a water shield during forward movement of the shuttle.

In an embodiment, the prow tube extends upward from 0-30 degrees, and preferably 15 degrees from the horizontal axis. The angle of the prow tube upwards from the water creates a natural keel shape, which is useful for the attachment of the water shield as described above. The keel shape is also created due to the fact that the top of the boat begins to angle upwards before the bottom of the boat begins to angle upwards.

In an embodiment, a variety of "D" rings and other handles may be positioned about the larger diameter exterior buoyancy tubes and the center seating tubes. Towing harness attachments are also disposed about the prow tube area for towing connections, to facilitate spreading towing forces across multiple points on the shuttle for improved stability.

In an embodiment, the shuttle has extra reinforced bottom layers for added abrasion resistance during beachfront landing and boarding, comfortable seating on a stable, wide center tube and easy grip PVC handles and numbered seats for easily directing passengers. The wide and high foot step tubes with non-slip pads provide a very stable ride and safer boarding and debarking.

Other features include: five air chambers ensure floatation in the event of an unexpected puncture; and easily tows behind personal watercraft with a sliding tow bridle constructed of super strong 10,500 lbs. parasail cord; or similar material.

Some embodiments provide stability in beach surf and rough wave conditions to allow parasailing operations on more days than previously possible with traditional banana boats.

Some embodiments provide improved efficiency for boarding and loading passengers which results in more rides per day and increased revenue for parasail operators.

Some embodiments provide uniquely designed outer buoyancy tubes to provide a tight fit and close height to passenger loading area on most parasail boats. This reduces risk of potential injury while boarding and debarking.

An embodiment relates to an inflatable shuttle boat including a seat tube, a pair of exterior buoyancy tubes, and a pair of foot support tubes. The seat tube has an elongate, cylindrical outer surface that is centrally located and extends from a front end to an aft end, the seat tube sized for single-file, straddled seating of a plurality of riders on top of the cylindrical outer surface. The pair of exterior buoyancy tubes have an elongate shape providing exterior sides of the inflatable shuttle boat, each of the pair of exterior buoyancy tubes having a larger diameter and height than the seat tube and extend in a parallel disposition to the seat tube at right and left sides. The pair of foot support tubes have elongate shapes extending adjacent and parallel to the seat tube in coupled engagement between the pair of exterior buoyancy tubes and the seat tube. Further, the seat tube and the pair of exterior buoyancy tubes each diverge from parallel orientations at the front end and converge to a prow which is further oriented in an upward disposition.

An embodiment relates to an inflatable shuttle boat, including an interior seat tube, foot support tubes, and a U-shaped exterior buoyancy tube. The interior seat tube has an elongate, cylindrical outer surface that is centrally located and extends from a front end to an aft end. The foot support tubes are located along adjacent parallel sides of the interior seat tube. The U-shaped exterior buoyancy tube defines side portions and a front portion of the perimeter of the inflatable shuttle boat. The side portions are located adjacent the sides of the foot support tubes and terminate at aft ends. Further, the interior seat tube and U-shaped exterior buoyancy tube connect at a prow portion which is oriented in an upward disposition.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
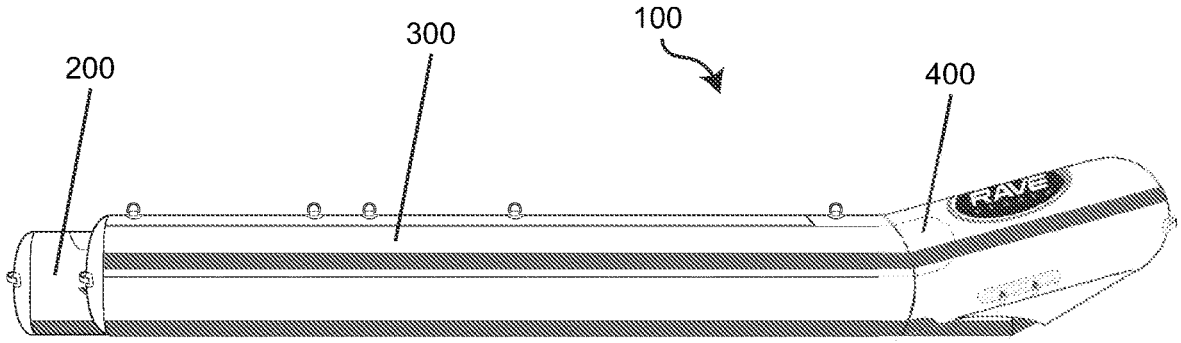
FIG. 1 depicts an embodiment of an inflatable shuttle boat from the side.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Figure 2:
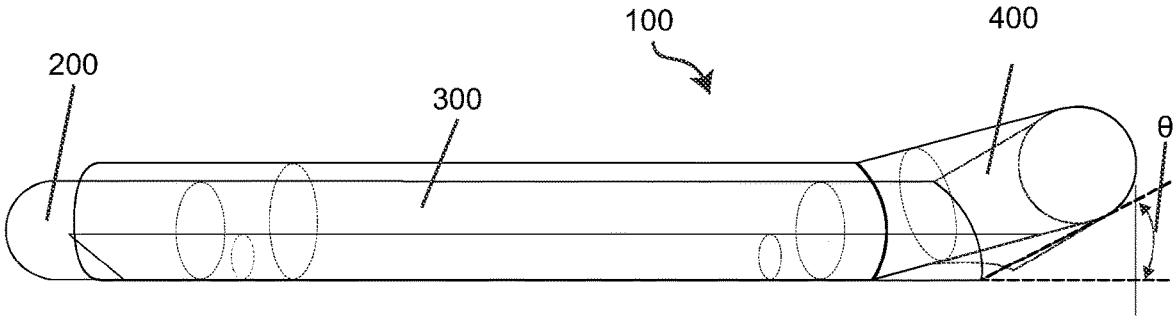
FIG. 2 depicts the inflatable shuttle boat of FIG. 1 from the side as a line drawing.

FIG. 1 illustrates an embodiment of an inflatable shuttle boat 100 from the side. A seat tube 200 is longer than an exterior buoyancy tube 300. Seat tube 200 and exterior buoyancy tubes 300 connect together to form a prow 400, which is raised up at an angle θ away from the water, to assist in fluid dynamics while inflatable shuttle boat 100 is being towed. FIG. 2 illustrates the same embodiment in a line drawing, with angle θ depicted at prow 400. Angle θ allows boat 100 to be towed more effectively, assisting towing via fluid dynamics for less friction and a smoother ride experience.

Figure 3:
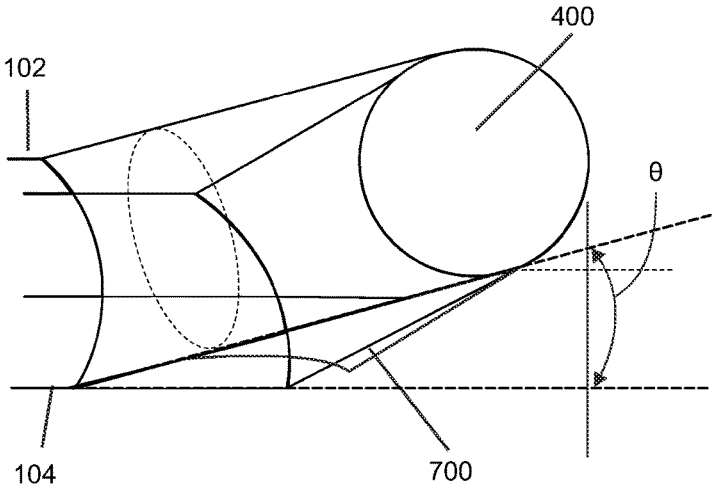
FIG. 3 depicts an expanded view of the front of the shuttle boat of FIG. 2.

FIG. 3 illustrates prow 400 in an expanded view for easier visibility of an underside panel 700 and angle θ. Underside panel 700 connects across exterior buoyancy tubes 300 for water deflection during forward motion of shuttle boat 100. Further, angle θ is associated with the topside 102 of boat 100, as opposed to the underside 104 of boat 100. Prow 400 is shaped as a natural keel as a result, as topside 102 begins to angle away from the water farther from prow 400, and underside 104 begins to angle away from the water closer to prow 400.

Figure 4:
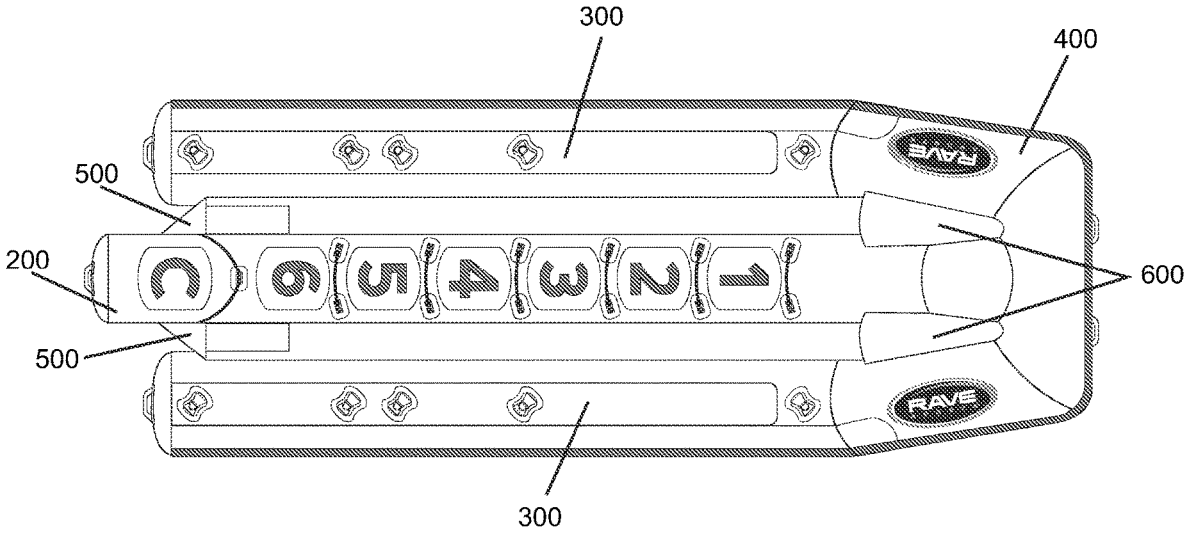
FIG. 4 depicts the inflatable shuttle boat of FIG. 1 from the top.

FIG. 4 illustrates the same embodiment from the top, where the construction of inflatable shuttle boat 100 is more easily viewed. Seat tube 200 is in the middle, with a foot support tube 500 on either side of seat tube 200. Foot support tube 500 is smaller in diameter from seat tube 200 and exterior buoyancy tubes 300, and sits lower than the seat tube and the pair of exterior buoyancy tubes. The seat tube and the pair of exterior buoyancy tubes define a pair of elongate gaps therebetween so that users who are straddling the seat tube may place their legs on either side of the seat tube between the seat tube and the pair of exterior buoyancy tubes to comfortably place their feet onto the pair of foot tubes 500. Exterior buoyancy tubes 300 sit adjacent to foot tubes 500, and are typically larger in diameter to seat tube 200 for added buoyancy and stability. Prow 400 construction is also easier viewed in FIG. 4, and depicts how seat tube 200 and exterior buoyancy tubes 300 connect via panel 600 in an embodiment. Seat tube 200 is longer than exterior buoyancy tubes 300, and prow 400 is square-shaped, though this could be formed in other shapes in various embodiments, such as oval or circular. Panels 600 serve to further join the wider seat tube 200 to the exterior buoyancy tubes 300. Panels 600 act as safety covers by covering openings which could pose a safety hazard for human entrapment. Additionally, the numbers 1 through 6 in FIG. 4 illustrate where users may sit in boat 100.

Figure 5:
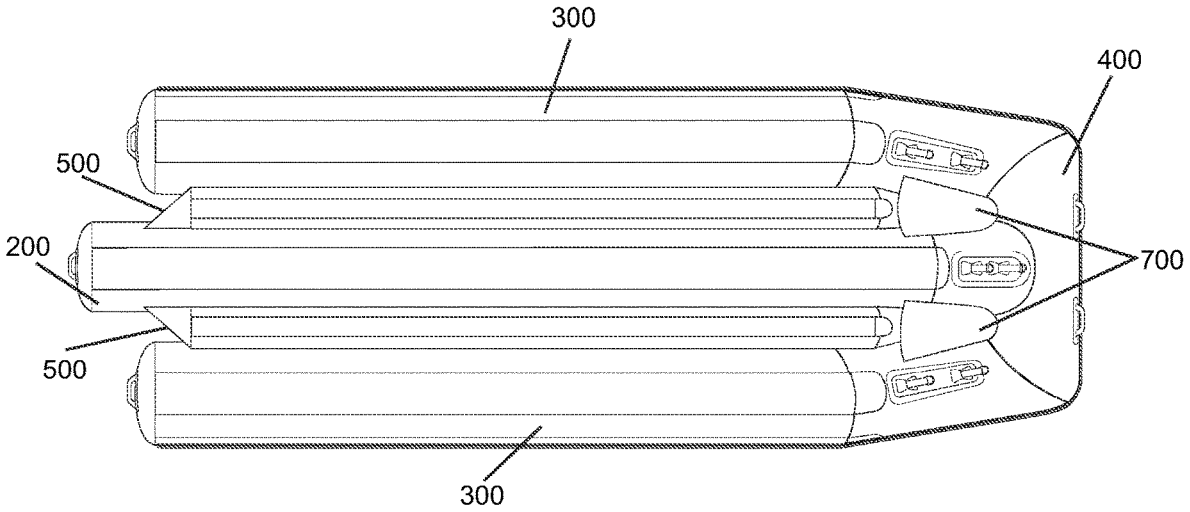
FIG. 5 depicts the inflatable shuttle boat of FIG. 1 from the bottom.

FIG. 5 illustrates the bottom of inflatable shuttle boat 100, with seat tube 200, foot tubes 500, exterior buoyancy tubes 300, prow 400, and an underside panel 700. Underside panels 700 are used as a water deflection shield to prevent water from getting between seat tube 200, foot tubes 500, and exterior buoyancy tubes 300 during forward shuttle movement across the water.

Figure 6:
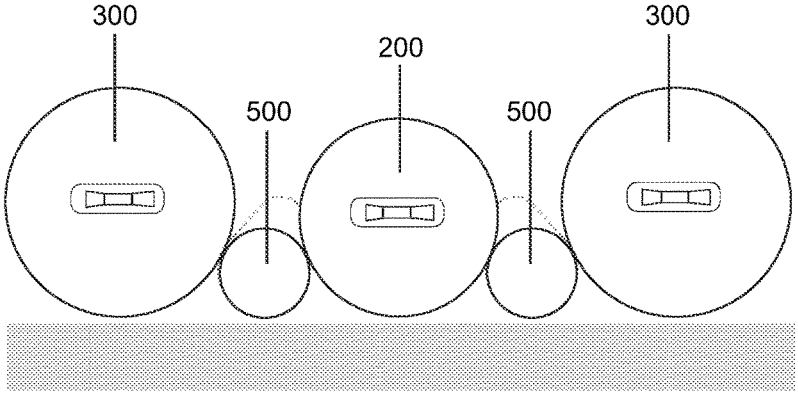
FIG. 6 depicts the inflatable shuttle boat of FIG. 1 from the back.
Figure 7:
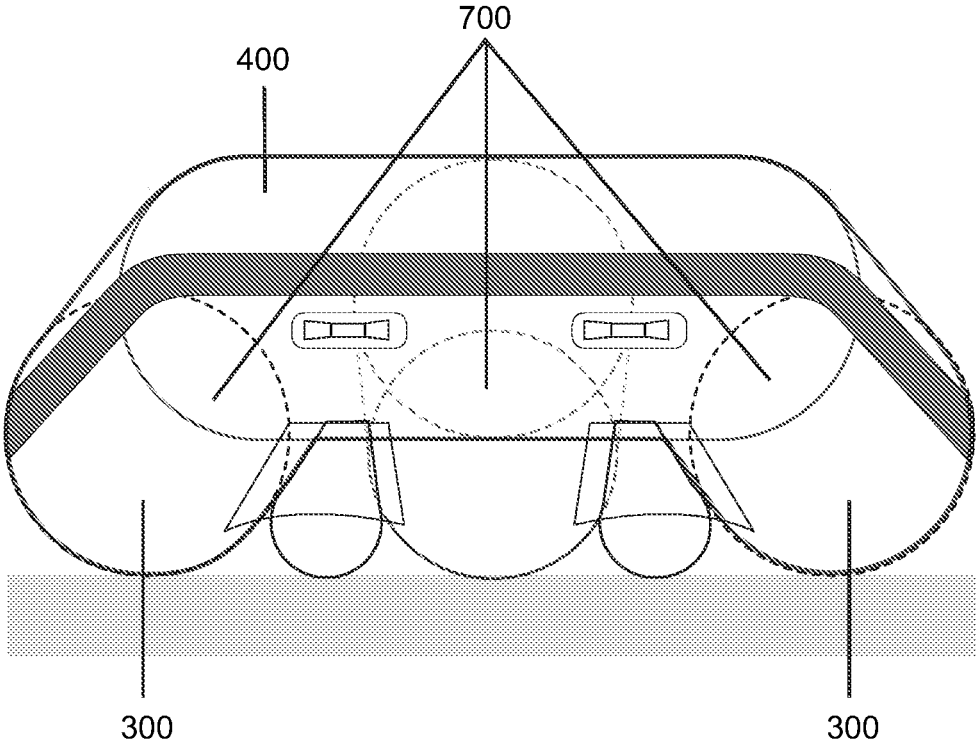
FIG. 7 depicts the inflatable shuttle boat of FIG. 1 from the front underside.

FIG. 6 illustrates the back of boat 100, with seat tube 200, foot tubes 500, and exterior buoyancy tubes 300. This shows how each of the tubes connects and sits on the water. FIG. 7 illustrates the front underside of boat 100, with seat tube 200, foot tubes 500, exterior buoyancy tubes 300, prow 400, and underside panel 700 according to a further embodiment. Underside panel 700 may connect exterior buoyancy tubes 300 together, as opposed to connecting seat tube 200 and exterior buoyancy tubes 300 as depicted in FIG. 5.

Figure 8:
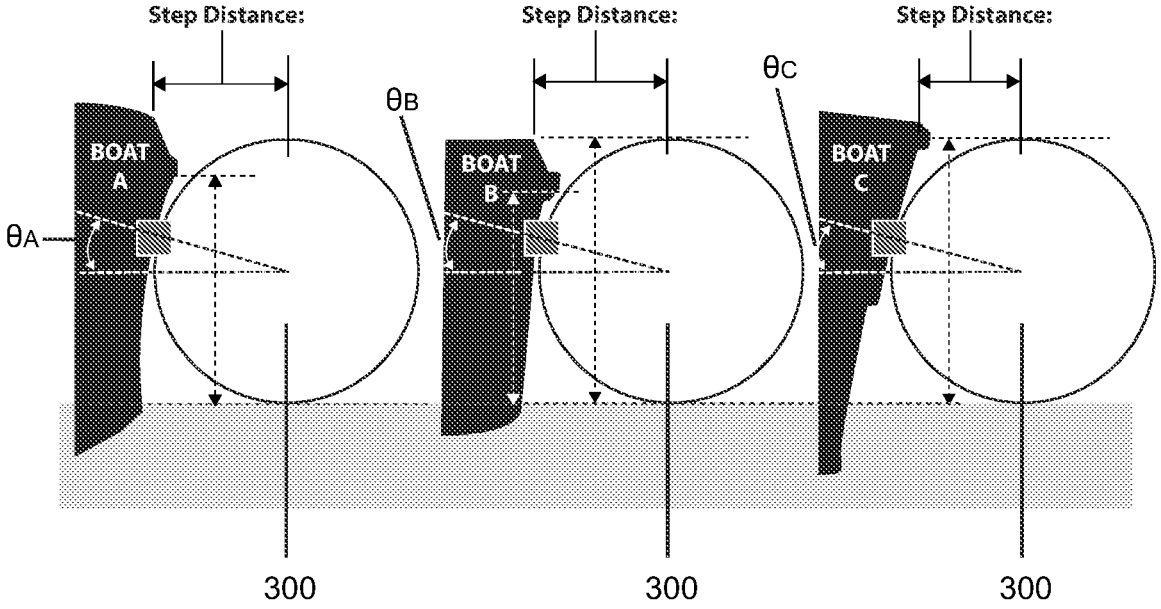
FIG. 8 depicts the interaction of the shuttle boat of FIG. 1 with various motorized boats during loading and unloading of passengers.

FIG. 8 illustrates how exterior buoyancy tubes 300 may interact with various motorized boats (the side profile of various motorized tow boats A, B, and C are each different). For different boats A, B, or C, the step distance and the step angle OA, B, or C varies. This illustrates how boat 100 and exterior buoyancy tubes 300 may successfully interact with various boats for loading of riders onto boat 100, with increased safety and stability by smaller step distances and step angles OA, B, or c. Embodiments of boat 100 thus allows for tight contact with motorized boats used for parasailing or other water sports, which in turn allows for safer transfer of riders from an inflatable shuttle to the motorized boat while both are in motion.

Figure 14:
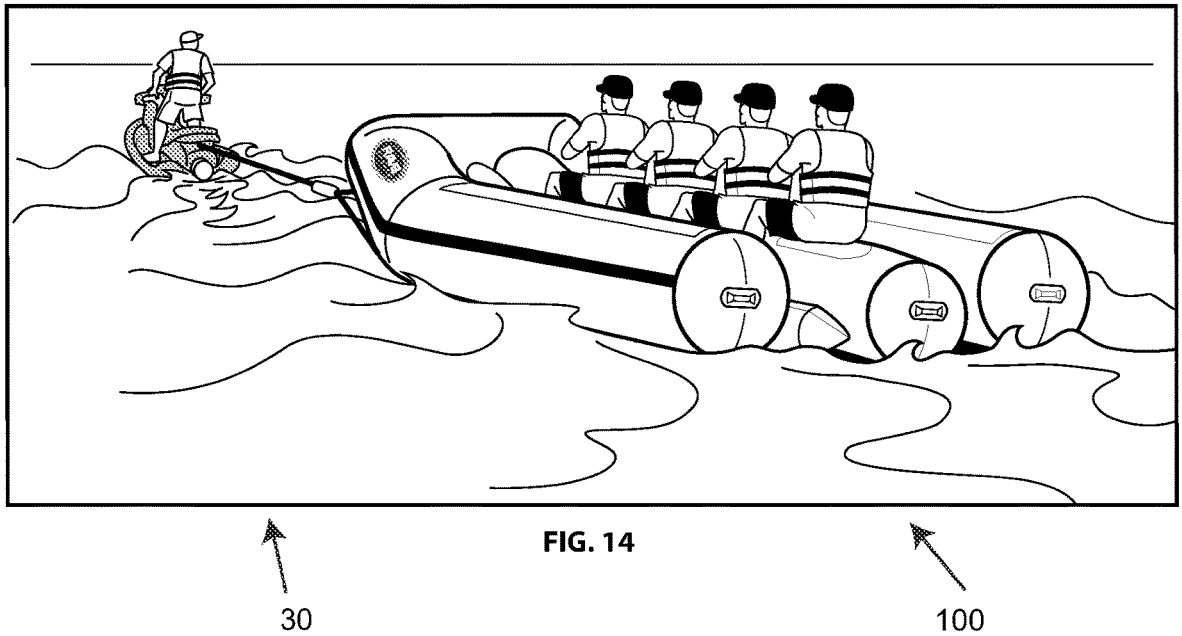
FIG. 14 depicts a perspective view of a jet ski towing an inflatable shuttle boat, according to an embodiment.

To arrive at a tow boat, inflatable shuttle boat 100 may be connected to a motorized boat or Jet Ski by way of a towing rope connected to prow 400, and thus pulls inflatable shuttle boat 100 behind it while on the water. Users may sit on seat tube 200 as depicted in FIG. 14. In various embodiments, inflatable shuttle boat 100 may be shorter or longer, to accommodate different numbers of users.

Figure 9:
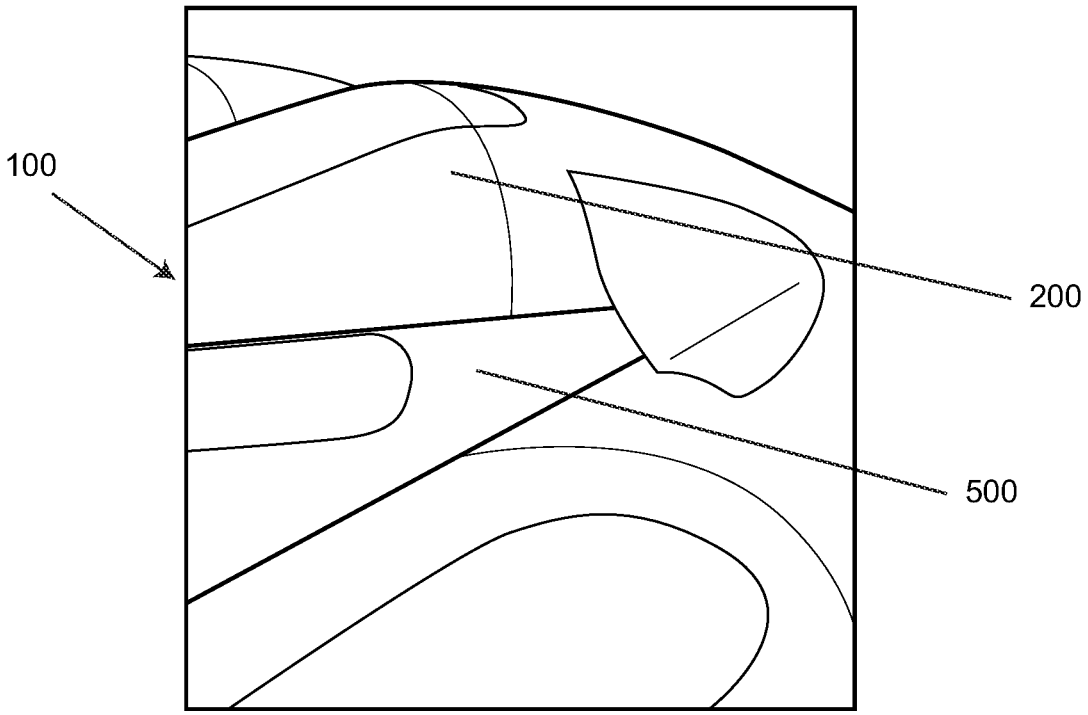
FIG. 9 depicts a perspective view of the shroud on the underside of the prow, according to an embodiment.
Figure 10:
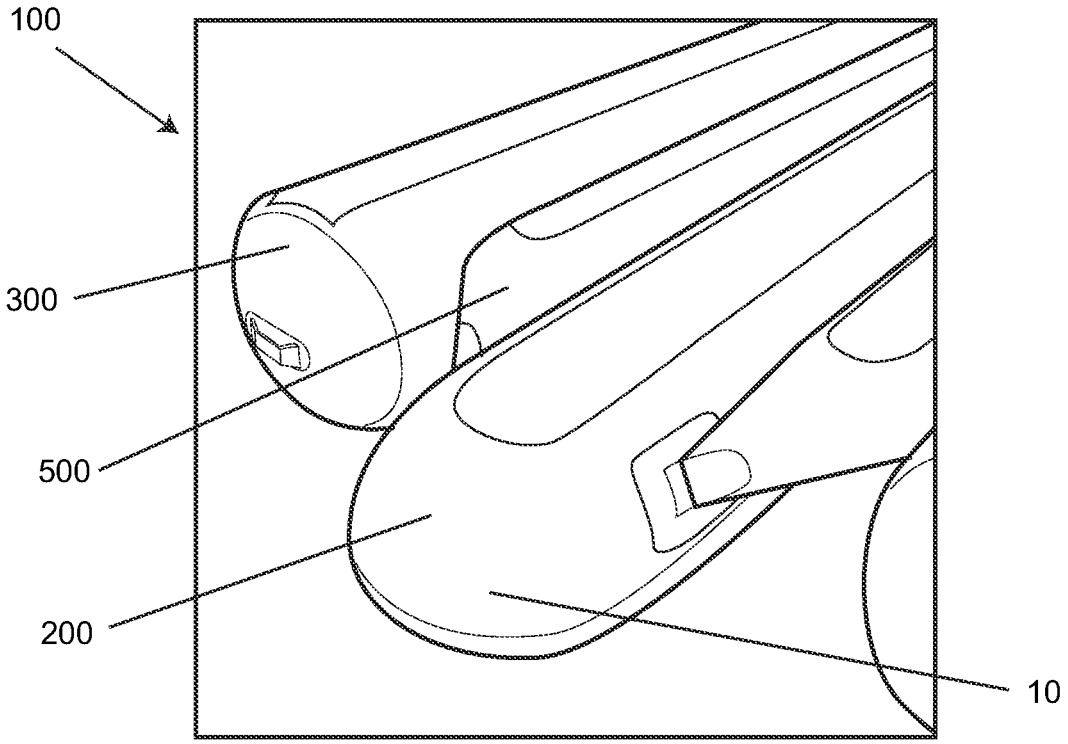
FIG. 10 depicts a perspective view of the underside of the aft end of the shuttle, according to an embodiment.

FIG. 9 depicts a perspective view of the shroud on the underside of the prow of the shuttle boat 100. The shroud extends across the foot tubes 500 and provides a water deflecting plane. FIG. 10 depicts a perspective view of the underside of the aft end of the shuttle 100. The aft end 10 of the seat tube 200 is rounded in this embodiment but other shapes could be used.

Figure 11:
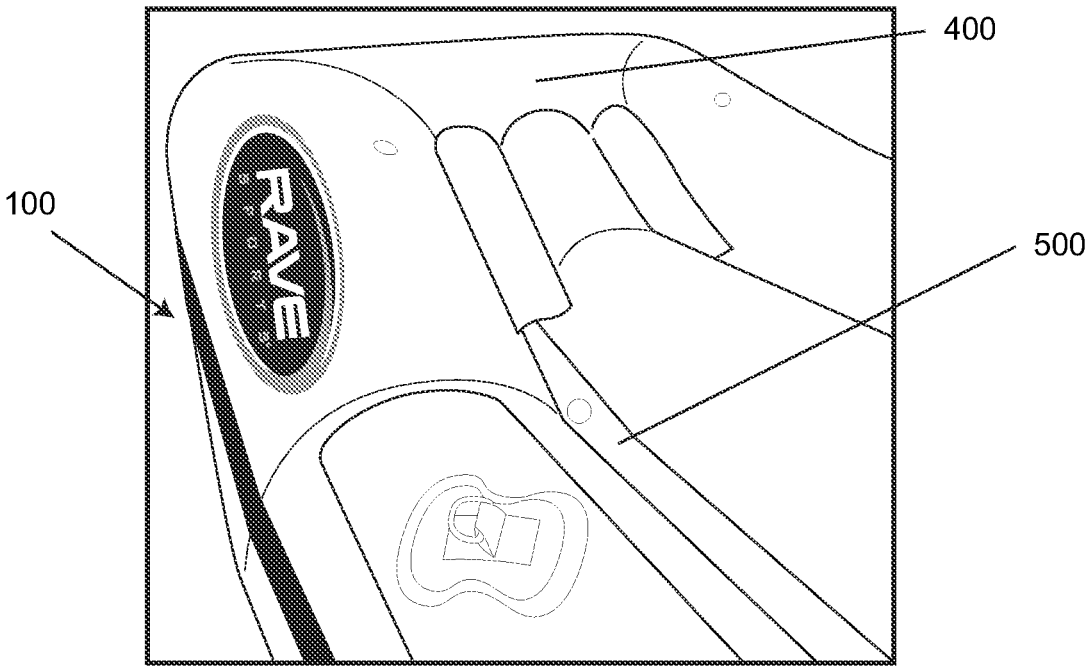
FIG. 11 depicts a perspective view of the shroud area at the prow of the shuttle, according to an embodiment.
Figure 12:
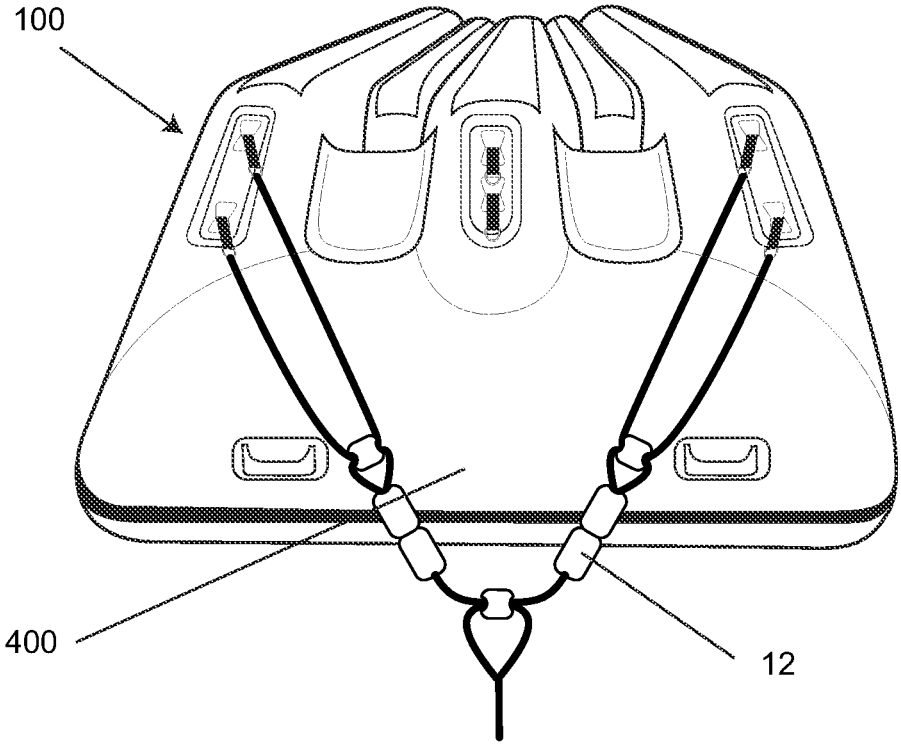
FIG. 12 depicts a perspective views of the underside prow and the sliding bridle system and multiple tow points, according to an embodiment.

FIG. 11 depicts a perspective view of the upper shroud area at the prow 400 of the shuttle 100. The shroud covers the area where the foot tubes 500 intersect the prow 400 section FIG. 12 depicts perspective view of the underside prow 400 and the sliding bridle system 12 and multiple tow points for the shuttle 100. Bridle system 12 includes a first series of tow points adjacent the prow of one exterior buoyancy tube 300 and a second series of tow points adjacent the prow of the opposite exterior buoyancy tube 300. A first rope has two ends connected to two tow points selected from the first series of tow points and a second rope has two ends connected to two tow points selected from the second series of tow points. Bridle system 12 further includes a pair of slides slidably arranged between the ends of the first and second ropes. The pair of slides are connected by a harness with a slideable tow ring configured to be connected to a tow rope. The sliding bridle system 12 is a unique solution to maintain a consistent tow force on attachment points while turning.

Figure 13:
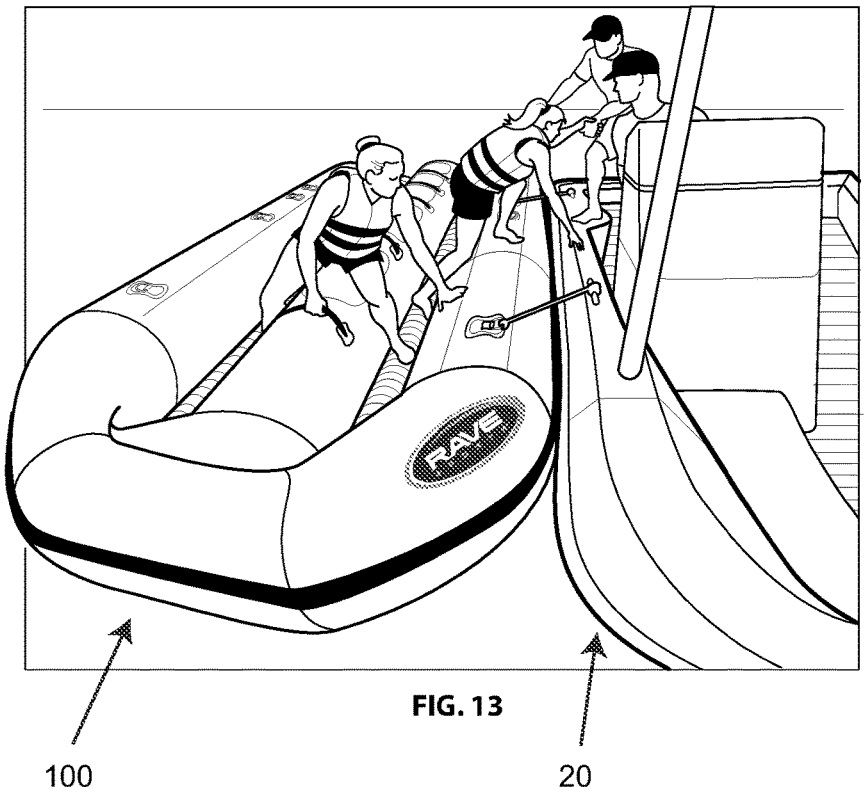
FIG. 13 depicts a perspective views of passengers transferring from a parasailing boat to an inflatable shuttle boat, according to an embodiment.

FIG. 13 depicts a perspective view of passengers transferring from a parasailing boat 20 to an inflatable shuttle boat 100.

FIG. 14 depicts a perspective view of a jet ski 30 towing an inflatable shuttle boat 100.

Figure 15:
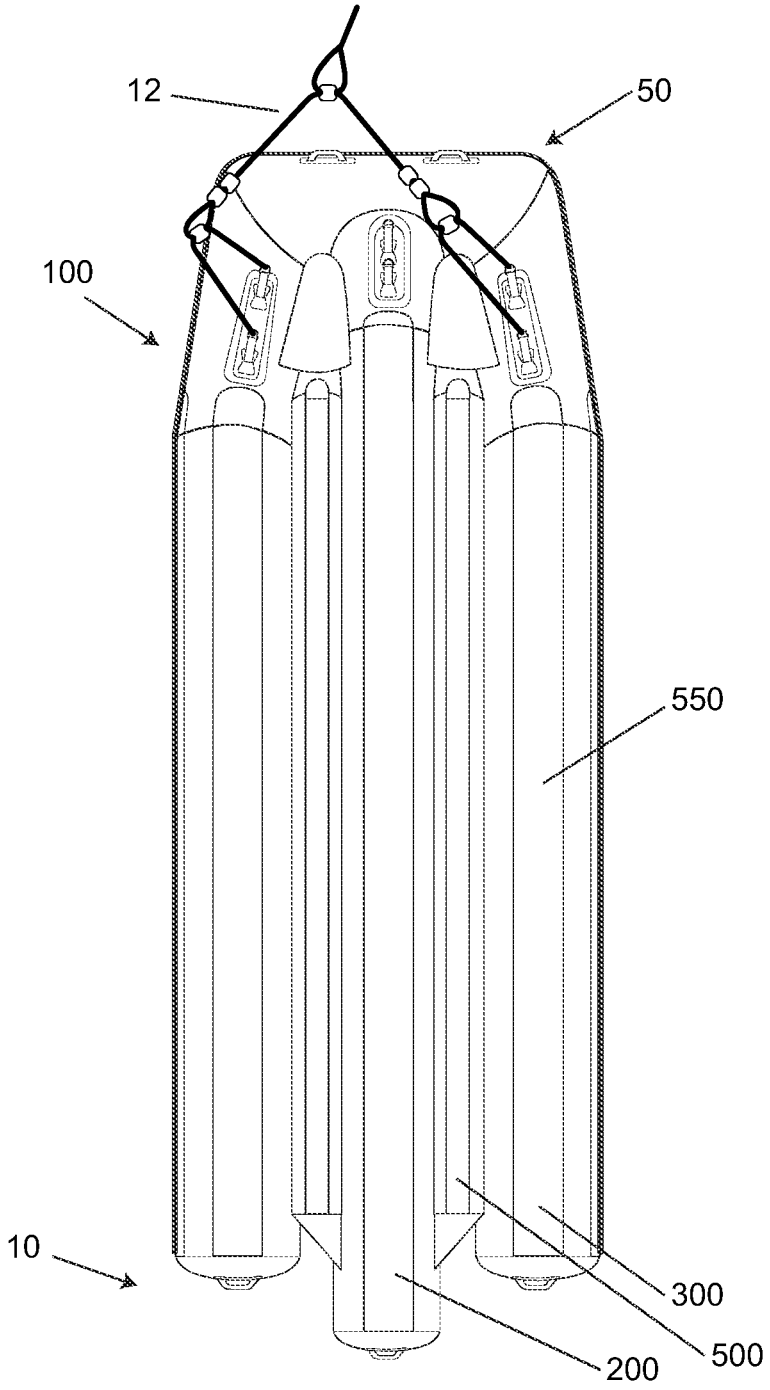
FIG. 15 depicts a planar view of the underside an inflatable shuttle boat, according to an embodiment.

FIG. 15 depicts a planar view of the underside of an inflatable shuttle boat 100 and features between its front end 50 and aft end 10. Seat tube 200, foot tubes 500 and exterior buoyancy tubes 300 may all be covered by abrasion guards 550 that prevent damage to the bottom of shuttle 100.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

The invention claimed is:

1. An inflatable shuttle boat, comprising, a seat tube of elongate, cylindrical outer surface shape that is centrally located and extends from a front end to an aft end, the seat tube sized for single-file, straddled seating by a plurality of riders on top of the cylindrical outer surface;

a pair of exterior buoyancy tubes of elongate shape providing exterior sides of the inflatable shuttle boat, each of the pair of exterior buoyancy tubes having a larger diameter and height than the seat tube and extend in a parallel disposition to the seat tube at right and left sides; and a pair of foot support tubes of elongate shape extending adjacent and parallel to the seat tube in coupled engagement between the pair of exterior buoyancy tubes and the seat tube;

wherein the foot support tubes sit lower than the seat tube and the pair of exterior buoyancy tubes whereby the seat tube and the pair of exterior buoyancy tubes define a pair of elongate gaps therebetween to allow riders sitting on top of the seat tube to place one leg on either side of the seat tube and between the seat tube and the pair of exterior buoyancy tubes to place their feet onto the foot support tubes;

wherein the seat tube and the pair of exterior buoyancy tubes each diverge from parallel orientations at the front end and converge to a prow which is further oriented in an upward disposition.

2. An inflatable shuttle boat of claim 1, wherein the seat tube contains a keel portion that extends further aft than the pair of exterior buoyancy tubes.

3. An inflatable shuttle boat of claim 1, wherein the exterior buoyancy tubes are connected at the prow to form a "U" shape.

4. An inflatable shuttle boat of claim 1, wherein the exterior buoyancy tubes are connected at the prow to form an oval shape or a circular shape.

5. An inflatable shuttle boat of claim 1, wherein PVC panels extend from the exterior buoyancy tubes to the seat tube proximate the prow to cover any exposed openings between the exterior buoyancy tubes and the seat tube.

6. An inflatable shuttle boat of claim 1, wherein PVC panels extend beneath the prow and act as a water shield.

7. An inflatable shuttle boat of claim 1, wherein D rings are positioned about the exterior buoyancy tubes.

8. An inflatable shuttle boat of claim 1, wherein towing harness attachments are disposed beneath the prow.

9. An inflatable shuttle boat of claim 1, wherein the seat tube contains a keel portion that extends beyond the pair of exterior buoyancy tubes converging at the prow.

10. An inflatable shuttle boat of claim 1, wherein the seat tube contains a keel portion that extends further aft than the pair of exterior buoyancy tubes and wherein the aft end of the seat tube is shaped to match the exterior buoyancy tubes.

11. An inflatable shuttle boat of claim 1, wherein the exterior buoyancy tubes are sized for tight fit against a motorized boat hull.

12. An inflatable shuttle boat of claim 1, wherein each of the pair of exterior buoyancy tubes has a larger diameter and height than the seat tube and wherein the seat tube has a larger diameter and height than the pair of foot support tubes.

13. An inflatable shuttle boat, comprising, an interior seat tube of elongate, cylindrical outer surface that is centrally located and extends from a front end to an aft end, the seat tube sized for single-file, straddled seating by a plurality of riders on top of the cylindrical outer surface;

foot support tubes located along adjacent parallel sides of the interior seat tube;

wherein the foot support tubes sit lower than the seat tube and the pair of exterior buoyancy tubes whereby the seat tube and the pair of exterior buoyancy tubes define a pair of elongate gaps therebetween to allow riders sitting on top of the seat tube to place one leg on either side of the seat tube and between the seat tube and the pair of exterior buoyancy tubes in order to place their feet onto the foot support tubes;

a U-shaped exterior buoyancy tube defining side portions and a front portion of the perimeter of the inflatable shuttle boat, the side portions located adjacent the sides of the foot support tubes and terminate at aft ends;

wherein the interior seat tube and U-shaped exterior buoyancy tube connect at a prow portion which is oriented in an upward disposition.

14. An inflatable shuttle boat of claim 1, wherein the seat tube contains a keel portion that extends further aft than the aft ends of the U-shaped exterior buoyancy tube.

15. An inflatable shuttle boat of claim 1, wherein PVC panels extend beneath the prow portion and act as a water shield.

16. An inflatable shuttle boat, comprising, an interior seat tube of elongate, cylindrical outer surface that is centrally located and extends from a front end to an aft end, the seat tube sized for single-file, straddled seating by a plurality of riders on top of the cylindrical outer surface;

a pair of exterior buoyancy tubes of elongate shape providing exterior sides of the inflatable shuttle boat, each of the pair of exterior buoyancy tubes having diameter and height equal to or greater than the seat tube and extending in a parallel disposition to the seat tube at right and left sides; and a pair of foot support tubes of elongate shape extending adjacent and parallel to the seat tube in coupled engagement between the pair of exterior buoyancy tubes and the seat tube;

wherein the foot support tubes sit lower than the seat tube and the pair of exterior buoyancy tubes whereby the seat tube and the pair of exterior buoyancy tubes define a pair of elongate gaps therebetween to allow riders sitting on top of the seat tube to place one leg on either side of the seat tube and between the seat tube and the pair of exterior buoyancy tubes in order to place their feet onto the foot support tubes.

17. The inflatable shuttle boat of claim 16, comprising a sliding bridle system including:

a first series of tow points adjacent the prow of one exterior buoyancy tube;

a second series of tow points adjacent the prow of the other exterior buoyancy tube;

a first rope having two ends connected to two tow points selected from the first series of tow points; a second rope having two ends connected to two tow points selected from the second series of tow points;

a pair of slides, with one slide slidably arranged between the ends of the first rope and a second slide slidably arranged between the ends of the second rope; and a harness connecting the pair of slide, the harness configured to be connected to a tow rope.

18. The inflatable shuttle boat of claim 16, wherein the seat tube contains a keel portion that extends further aft than the pair of exterior buoyancy tubes.

19. The inflatable shuttle boat of claim 16, wherein each of the pair of exterior buoyancy tubes has a larger diameter and height than the seat tube and wherein the seat tube has a larger diameter and height than the pair of foot support tubes.

20. The inflatable shuttle boat of claim 16, wherein the seat tube and the pair of exterior buoyancy tubes each diverge from parallel orientations at the front end and converge to a prow.

* * * * *